US006557212B2

(12) United States Patent
Huang

(10) Patent No.: US 6,557,212 B2
(45) Date of Patent: May 6, 2003

(54) FASTENING STRUCTURE OF A HANDLE AND WORKING PART OF A TOOL

(76) Inventor: Yu-Hsin Huang, No.2, Alley 1, Lane 722, Sec.4, Yen Hai Rd., Fu Shing Hsiang Chang Hua Hsien (TW)

( * ) Notice: Subject to any disclaimer, the term of this patent is extended or adjusted under 35 U.S.C. 154(b) by 0 days.

(21) Appl. No.: 09/973,164

(22) Filed: Oct. 9, 2001

(65) Prior Publication Data

US 2003/0066167 A1 Apr. 10, 2003

(51) Int. Cl.[7] ..... A45C 13/22; B25G 3/00

(52) U.S. Cl. ..... 16/430; 16/422; 16/436; 16/DIG. 41; 16/DIG. 40; 15/145

(58) Field of Search ..... 16/422, 426, 436, 16/430, DIG. 40, DIG. 41; 403/348, 350, 351, 323, 361, 362; 172/371, 378; 294/57–59; 220/759; 81/177.1, 489, 492; 24/647, 650; 411/349, 351; 76/106, 105, 104.1; 30/169, 199, 340–344; 15/143.1, 145

(56) References Cited

U.S. PATENT DOCUMENTS

| | | | | | |
|---|---|---|---|---|---|
| 939,019 | A | * | 11/1909 | Hartwell | 279/97 |
| 1,483,435 | A | * | 2/1924 | Hammer | 16/422 |
| 2,610,354 | A | * | 9/1952 | Howell | 15/145 |
| 3,182,770 | A | * | 5/1965 | Shemet | 403/408.1 |
| 3,438,082 | A | * | 4/1969 | Jones et al. | 220/759 |
| 3,881,334 | A | * | 5/1975 | Wilson | 24/637 |
| 5,123,767 | A | * | 6/1992 | Ishikura et al. | 280/47.38 |
| 5,803,646 | A | * | 9/1998 | Weihrauch | 15/145 |
| 6,393,647 | B1 | * | 5/2002 | Libman | 15/145 |
| 6,439,421 | B1 | * | 8/2002 | Lin | 16/425 |

FOREIGN PATENT DOCUMENTS

| | | | |
|---|---|---|---|
| EP | 430749 | A | * 6/1991 |
| FR | 2765094 | A1 | * 12/1998 |
| GB | 1432938 | | * 4/1976 |

* cited by examiner

*Primary Examiner*—Chuck Y. Mah
(74) *Attorney, Agent, or Firm*—Harrison & Egbert

(57) ABSTRACT

A structure is designed to fasten detachably the handle and the working part of a hand tool. The structure includes a fastening base located at one end of the handle, a fastening end located at one end of the working part, and a fastening device. The fastening end is detachably fastened to the fastening base in conjunction with the fastening device. As the fastening device is turned such that two planar surfaces of the fastening device are aligned with two side walls of an open end of the retaining hole of the fastening end of the working part, the fastening device can be moved out of the retaining hole so as to enable the handle and the working part to separate from each other.

3 Claims, 8 Drawing Sheets

FASTENING STRUCTURE OF A HANDLE AND WORKING PART OF A TOOL

BACKGROUND OF THE INVENTION

1. Field of the Invention

The present invention relates generally to a hand tool, and more particularly to a structure for fastening detachably the handle and the working part of the hand tool.

2. Description of Related Art

The conventional hand tools, such as rake, spade, hoe, etc., comprise a handle, and a working part which is fastened undetachably with the handle. As a result, when the handle or working part of the hand tool is damaged, the hand tool is discarded in its entirety, thereby resulting in a waste of material resource as well as an increase in garbage. In addition, the conventional hand tools take up a relatively large storage space.

BRIEF SUMMARY OF THE INVENTION

The primary objective of the present invention is to provide a structure for fastening detachably the handle and the working part of a hand tool.

It is another objective of, the present invention to provide a hand tool with a handle which can be interchangeably fastened with various working parts.

The foregoing objectives of the present invention are achieved by a structure comprising a handle, a fastening device, and a working part. The handle and the working part are provided at one end thereof with a fastening means by which the handle and the working part are fastened detachably in conjunction with the fastening device.

The foregoing objectives, features and functions of the present invention will be more readily understood upon a thoughtful deliberation of the following detailed description of the present invention with reference to the accompanying drawings.

DETAILED DESCRIPTION OF THE INVENTION

Figure 1:
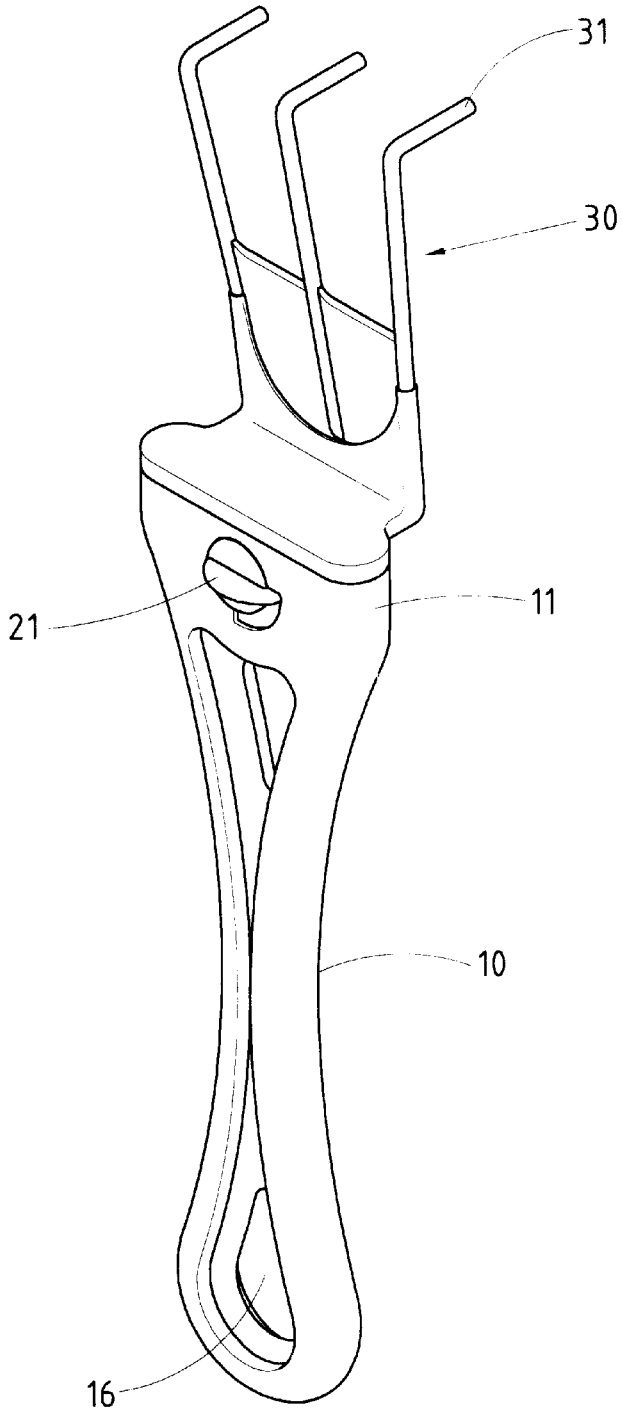
FIG. 1 shows a perspective view of a hand tool of the present invention.
Figure 2:
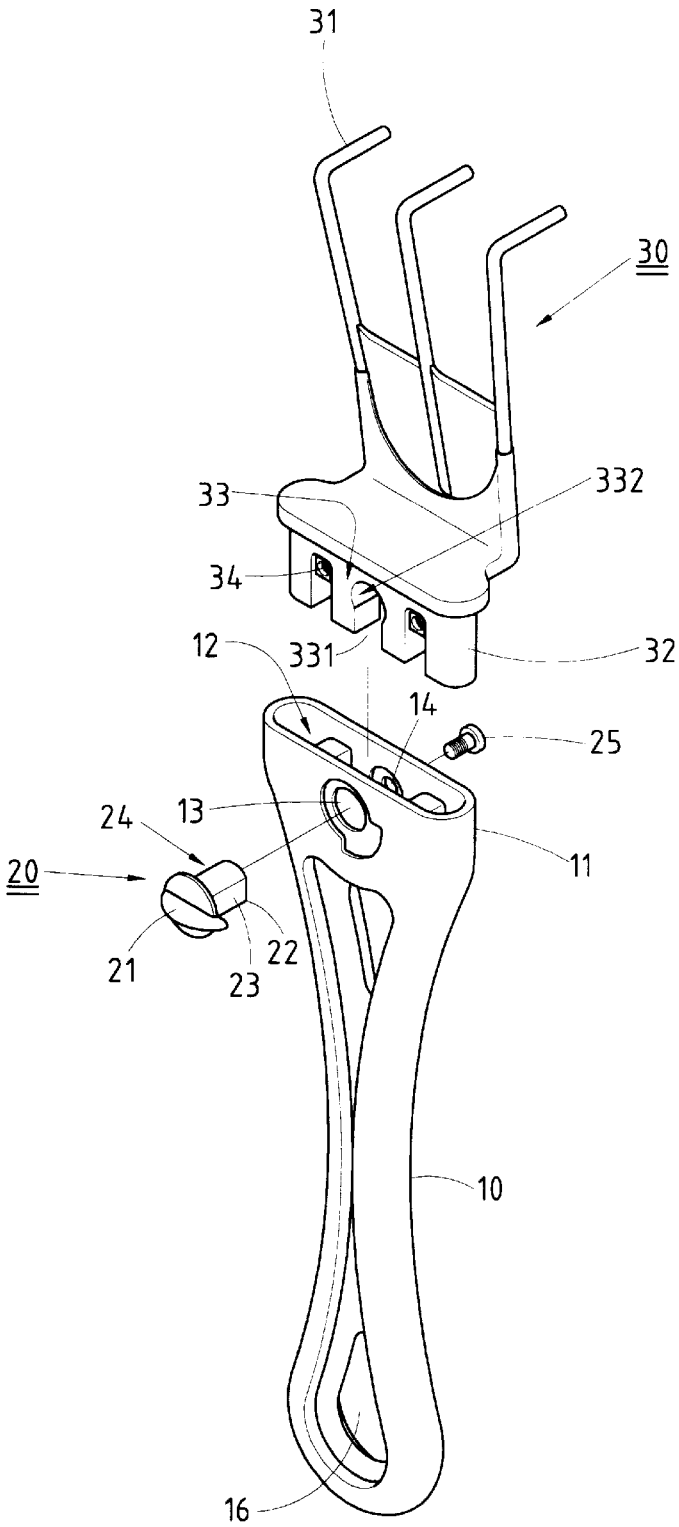
FIG. 2 shows an exploded view of the hand tool of the present invention as show in FIG. 1.

As shown in FIGS. 1–4, a hand tool embodied in the present invention comprises a handle 10 and a working part 30, which are detachably fastened together end to end by a fastening structure.

The present invention is characterized by the fastening structure, which comprises a fastening base 11 of the handle 10, a fastening end 32 of the working part 30, and a fastening device 20.

The fastening base 11 of the handle 10 is provided with a receiving slot 12, a pivoting hole 13, and a through hole 14 opposite in location to and smaller in diameter than the pivoting hole 13.

The fastening end 32 of the working part 30 is fitted into the receiving slot 12 of the fastening base 11 of the handle 10 and is provided with a retaining hole 33 corresponding in location to the pivoting hole 13 of the fastening base 11 of the handle 10. The retaining hole 33 is provided with an open end 331 and an inner portion 332 greater in hole diameter than the open end 331. The working part 30 has a functional portion 31.

Figure 3:
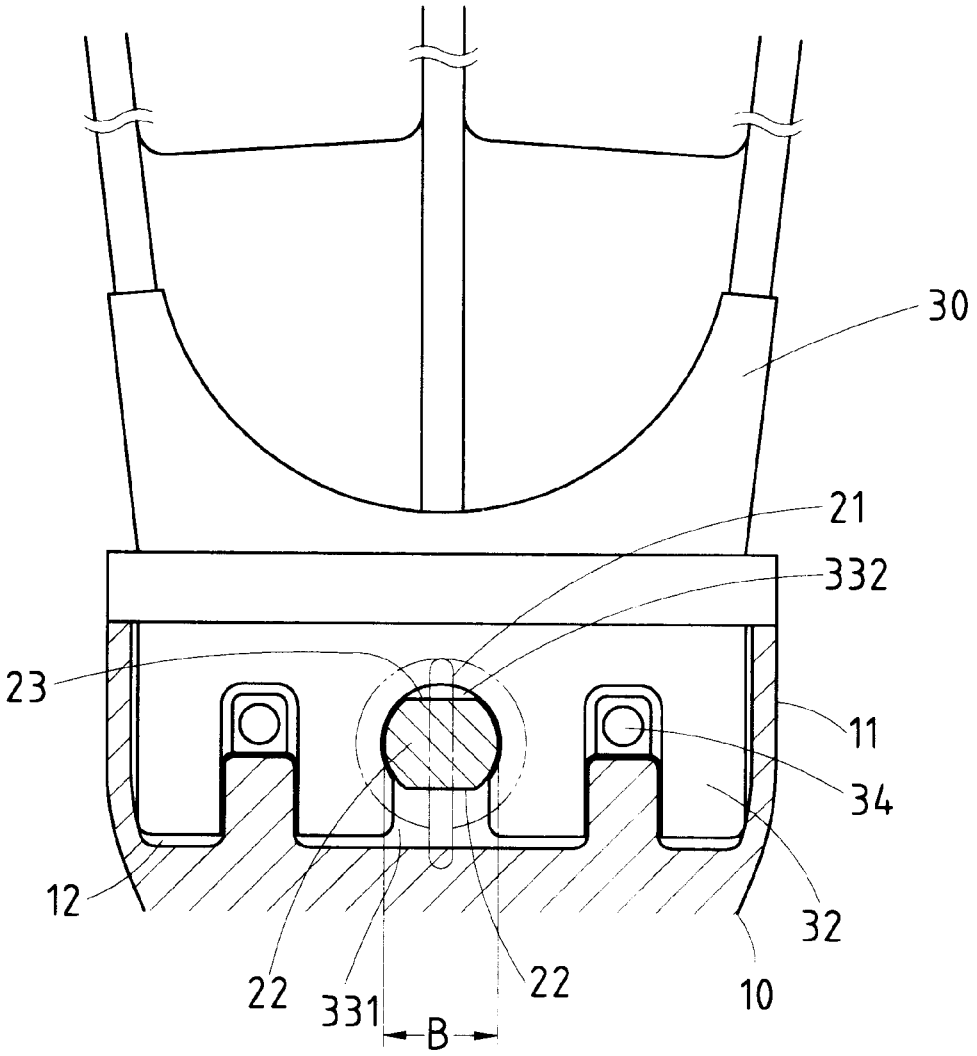
FIG. 3 shows a sectional view of a fastening structure present invention.
Figure 4:
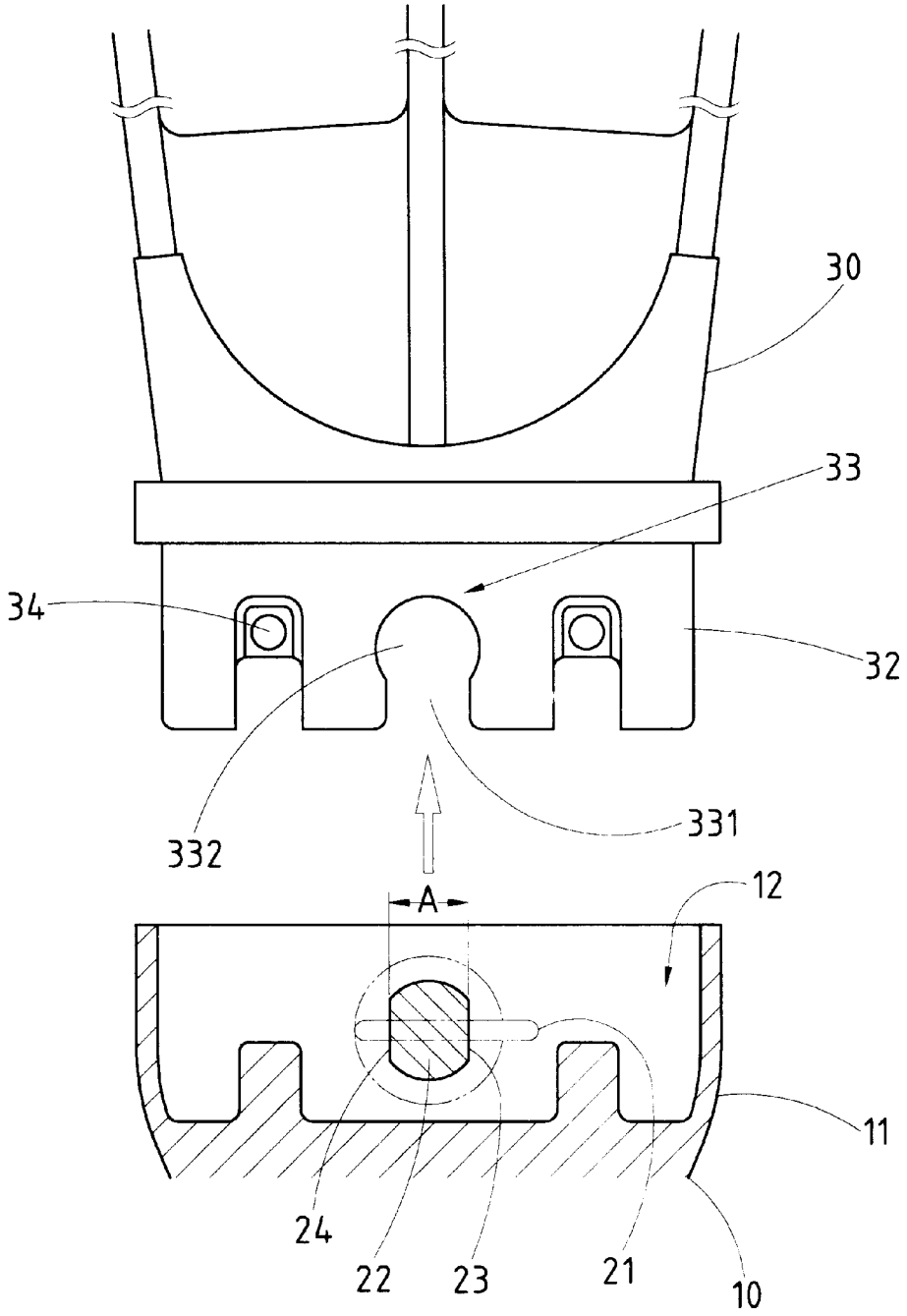
FIG. 4 shows a schematic view of a mechanism by which the handle and the working part of the present invention are detachably fastened together.
Figure 5:
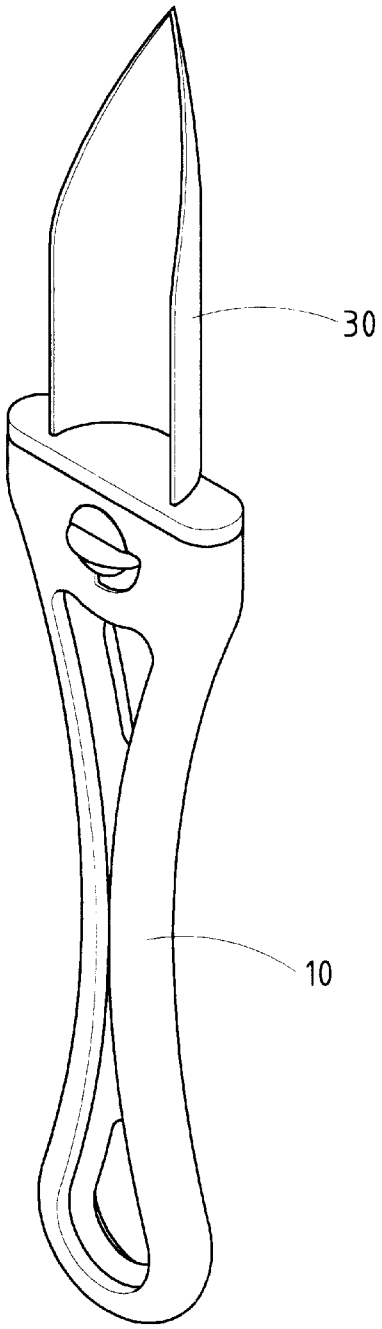
FIGS. 5–7 are schematic views to show that the handle of the present invention is interchangeably fastened to the working parts of different kinds.
Figure 6:
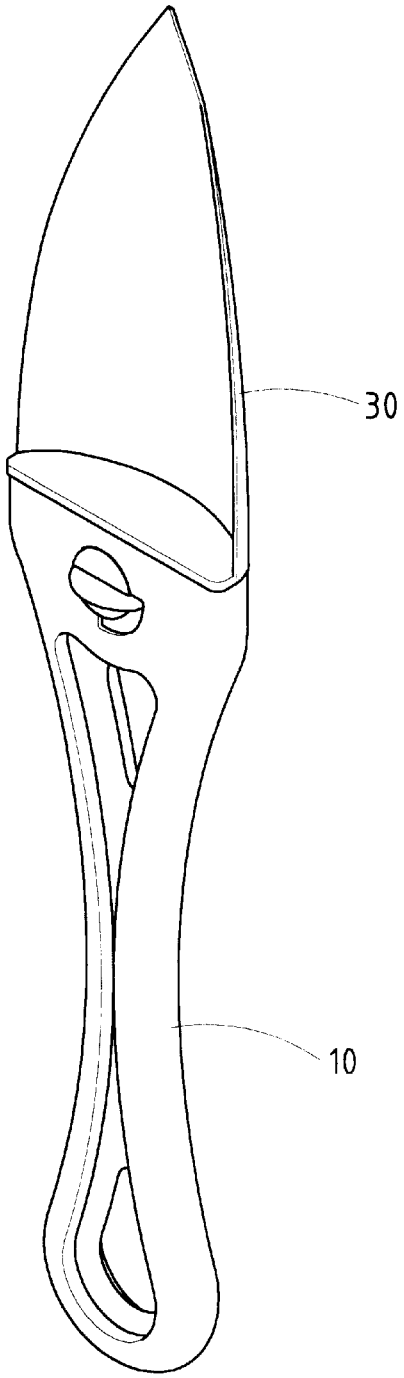
Figure 7:
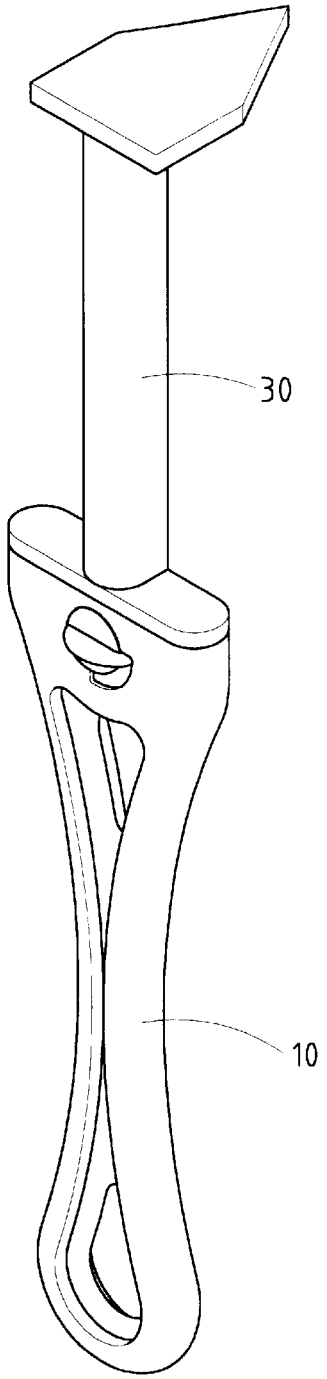

The fastening device 20 comprises a rotary bolt 21 and a screw 25. The rotary bolt 21 has a locating shank 22 which is provided at one end with a threaded hole (not shown in the drawing) engageable with the screw 25. The shank 22 is further provided with two planar surfaces 23 and 24, which are opposite in location to each other and are extended along the longitudinal direction of the shank 22. The two planar surfaces 23 and 24 of the locating shank 22 are separated from each other by a distance "A" which is slightly smaller than the horizontal width "B" of the locating shank 22, as shown in FIGS. 3 and 4.

In combination, the fastening end 32 of the working part 30 is fastened detachably with the fastening base 11 of the handle 10 by the fastening device 20 such that the locating shank 22 of the rotary bolt 21 of the fastening device 20 is received in the retaining hole 33 via the pivoting hole 13 of the fastening base 11, and that the screw 25 is engaged with the threaded hole of the locating shank 22 via the through hole 14 of the fastening base 11 of the handle 10. As shown in FIG. 4, when the two planar surfaces 23 and 24 of the locating shank 22 are aligned with the two opposite side walls of the open end 331 of the retaining hole 33, the locating shank 22 can be put into the inner portion 332 of the retaining hole 33. As the rotary bolt 21 is turned such that the two planar surfaces 23 and 24 of the locating shank 22 of the rotary bolt 21 are no longer aligned with the side walls of the open end 331 of the retaining hole 33, the fastening end 32 of the working part 30 is securely retained by the locating shank 22 of the rotary bolt 21, as shown in FIG. 3. The handle 10 and the working part 30 are thus fastened together end to end by the fastening device 20. The handle 10 and the working part 30 are unfastened by turning the rotary bolt 21 such that the two planar surfaces 23 and 24 of the locating shank 22 of the rotary bolt 21 are aligned with the two sidewalls of the open end 331 of the retaining hole 33, so as to enable the locating shank 22 of the rotary bolt 21 to be pulled out of the retaining hole 33 via the open end 331.

Figure 8:
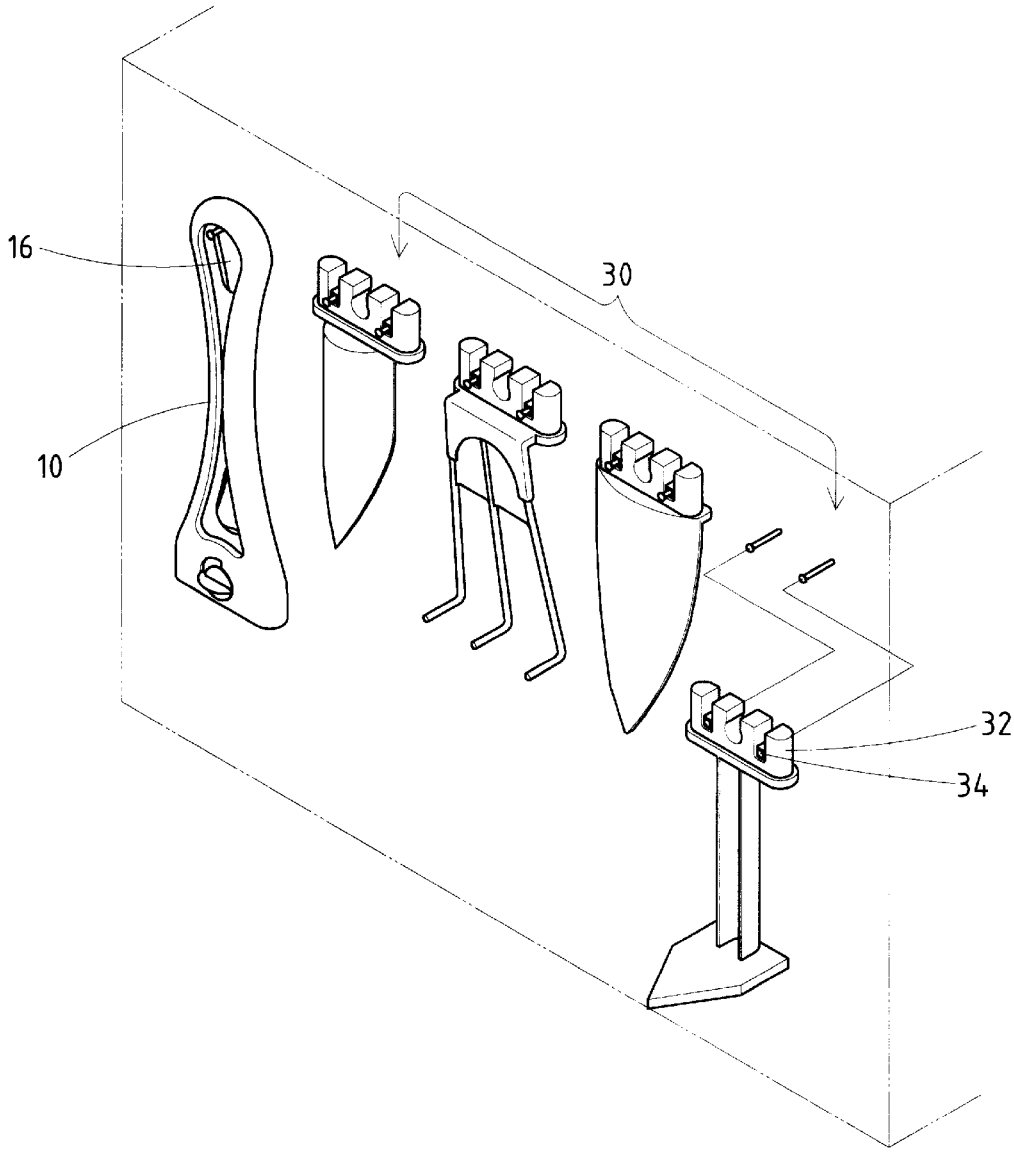
FIG. 8 shows a schematic view of the way by which the handle and various working parts of the present invention are independently held by a rack.

The handle 10 is provided at a tail end with a hanging hole 16 to facilitate the hanging of the handle 10 by a tool rack, as illustrated in FIG. 8. Similarly, the fastening end 32 of the working part 30 is provided with one or more hanging holes 34 by means of which the working part 30 is held on to the tool rack, as illustrated in FIG. 8.

The present invention described above is to be regarded in all respects as being merely illustrative and nonrestrictive. Accordingly, the present invention may be embodied in other specific forms without deviating from the spirit thereof. The present invention is therefore to be limited only by the scope of the following claims.

I claim:

1. An apparatus comprising:

a handle;

a hand tool having a working part;

a fastening base positioned at one end of said handle, said fastening base having a receiving slot opening at said one end, said fastening base having a pivoting hole and a through hole opposite in location to said pivoting hole, said through hole being smaller in diameter than said pivoting hole;

a fastening end positioned at one end of said hand tool, said fastening end having a retaining hole aligned with said pivoting hole of said fastening base, said retaining hole being of keyhole shape and having an extending portion opening to an end of said fastening end and an inner portion communicating with said extending portion and positioned away from said end of said fastening end of said hand tool, said inner portion having a diameter dimension greater than a width dimension of said extending portion; and a fastening device comprising a rotary bolt and a screw, said rotary bolt having a threaded hole at one end thereof, said threaded hole engaged with said screw, said rotary bolt having a locating shank with two planar surfaces opposite in location to each other, said two planar surfaces being in spaced parallel planar relationship to each other, said shank having a diameter dimension across said planar surfaces smaller than a diameter dimension of said shank away from said planar surfaces, said fastening end of said hand tool being detachably fastened to said fastening base of said handle such that said fastening end is fitted into said receiving slot, said locating shank being received in said inner portion of said retaining hole, said locating shank extending through said pivoting hole, said rotary bolt being rotatable between a first position in which said two planar surfaces are not aligned with two side walls of said extending portion of said retaining hole such that said fastening end is fixedly retained in said receiving slot and a second position in which said two planar surfaces are aligned with said two side walls of said extending portion of said retaining hole such that said fastening end can be slidably separated from said receiving slot.

2. The apparatus of claim 1, said handle having a hole formed at an end opposite said fastening base.

3. The apparatus of claim 1, said fastening end of said hand tool having at least one hanging hole formed therein.

* * * * *